US007100627B2

(12) United States Patent
Hollander

(10) Patent No.: US 7,100,627 B2
(45) Date of Patent: Sep. 5, 2006

(54) TRANSPORTING FLUIDS THROUGH A CONDUIT

(75) Inventor: Elco Dick Hollander, Amsterdam (NL)

(73) Assignee: Shell Oil Company, Houston, TX (US)

( * ) Notice: Subject to any disclaimer, the term of this patent is extended or adjusted under 35 U.S.C. 154(b) by 41 days.

(21) Appl. No.: 11/007,495

(22) Filed: Dec. 8, 2004

(65) Prior Publication Data

US 2005/0194042 A1 Sep. 8, 2005

(30) Foreign Application Priority Data

Dec. 9, 2003 (EP) ..... 03104605

(51) Int. Cl.
*F15D 1/06* (2006.01)

(52) U.S. Cl. ..... 137/1; 137/2

(58) Field of Classification Search ..... 137/1
See application file for complete search history.

(56) References Cited

U.S. PATENT DOCUMENTS

| | | | | |
|---|---|---|---|---|
| 2,953,146 A | * | 9/1960 | Gordon | 137/1 |
| 3,198,201 A | * | 8/1965 | Every et al. | 137/1 |
| 3,757,813 A | | 9/1973 | Levenberg | |
| 5,158,579 A | | 10/1992 | Carstensen | |

FOREIGN PATENT DOCUMENTS

| | | |
|---|---|---|
| DE | 3912613 | 11/1989 |
| SU | 1260310 | 9/1986 |
| SU | 1548141 | 3/1990 |
| WO | 95/12741 | 5/1995 |

OTHER PUBLICATIONS

EPC Search Report dated Jul. 16, 2004.
Koisumi, Y. et al.: "Investigation of horizontal two-phase flow in a long and large diameter pipe" Jun. 12, 1989, R. S.L. Lee, F. Durst, Taipei/Taiwan XP002279005.
Report preliminary experiments on ISPtech.
G.I. Taylor, 'The dispersion of matter in turbulent flow through a pipe', Proc.Royal Soc. London, A223, pp. 446(1954).
L. J. Tichacek et al., Axial Mixing in Pipes, AichE J. 3-4 pp. 439 (1957).
W.B. Krantz et al., Axial dispersion in the turbulent flow of power-law fluids in straight tubes, Ind Eng Chem Fundam, 13-1, pp. 56(1974).
J. E. Austin et al., 'Mixing of miscible but dissimilar liquids in serial flow in a pipeline', Proc Instn Mech Engnrs 178-15, pp. 377 (1964).

* cited by examiner

*Primary Examiner*—Ramesh Krishnamurthy
(74) *Attorney, Agent, or Firm*—Charles W. Stewart

(57) ABSTRACT

A method of sequentially transporting a first and a second fluid at a volumetric flow rate through a conduit having a cross-section, wherein the first and second fluids have different densities, which method comprises the steps of estimating a critical stratification condition for a fluid density profile along the conduit, which condition takes into account the densities of the first and second fluids, the cross-section of the conduit and the volumetric flow rate, and wherein violating the critical stratification condition likely results in stratification of fluids to occur; and feeding sequentially only first fluid, a buffer fluid and only second fluid into the conduit, wherein the buffer fluid has a density between the densities of the first and second fluids, such that a density profile of fluid along the conduit is provided, which does not violate the critical stratification condition.

10 Claims, 4 Drawing Sheets

TRANSPORTING FLUIDS THROUGH A CONDUIT

BACKGROUND

The present invention relates to a method of sequentially transporting a first and a second fluid through a conduit.

Sequential transporting of two fluids through a conduit is frequently encountered in the process industry, e.g. around refineries, petrochemical and chemical plants. Multi-product pipeline conduits are used to transport fluids over short distances, such as on a plant site between one unit or tank and another, but also over long distances, for tens, hundreds or more kilometers. The fluids can be liquids, in the case of a refinery for example mogas, gasoil, kerosene or other refinery streams of different product qualities and grades. The fluids can also be gases such as natural gas and nitrogen, for example in cases where nitrogen is occasionally used for purging a natural gas pipeline.

A problem that is commonly encountered when transporting different fluids sequentially through a pipeline is mixing between the tail end of the first fluid batch and the front end of the second fluid. If the transport takes place over long distances, the length of pipeline containing both first and second fluid can be substantial, several hundreds or even thousands of meters long. Generally one obtains large amounts of off-spec material in this way, which has to be downgraded or is even wasted.

Several effects contribute to this. Mixing of fluids at a microscopic level takes place due to diffusion, turbulent dispersion and residence time distribution effects at the interface. Macroscopically, a particularly serious problem is encountered in non-vertical, in particular (nearly) horizontal conduits, when the fluids happen to stratify in the conduit, due to a density difference between the fluids. For example, when the second fluid that is fed into the pipeline after the first fluid, is lighter than the first fluid, the second fluid may not fully displace the first fluid from the full cross-section of the pipeline but may float over the first fluid so that two moving layers of fluid are obtained. A heavier second fluid can also shift under a lighter first fluid. It is particularly in such a case of stratification that very long lengths of pipeline are filled with both fluids. In many cases only limited actual microscopic mixing between the fluids at the nearly horizontal interface is observed.

This problem is currently dealt with in various ways. If the pipeline is short, one may simply accept the situation and dispose of the off-spec material obtained. A common way to prevent mixing and stratification is to use a mechanical separation by separating plugs, such as spheres from a flexible material, often referred to as "pigs". A problem associated with these plugs is that they can get stuck along the pipeline, and that they may also cause unsafe situations particularly at the end of the pipeline where they have to be separated from the fluids. Also, a launch facility for the plugs at the pipeline inlet is needed. An alternative for a flexible sphere is to use a plug of gel ("gel pigs"). Contrary to fluids, a gel exhibits a finite yield stress which is the stress at which the gel begins to flow. Below the yield stress, the gel behaves essentially as a flexible solid, and it is in this regime that gel pigs are operated. Gel pigs are however generally rather expensive since relatively large amounts of chemicals are required to fill a sufficiently long length of pipeline. Gel pigs also introduce substances different from the process fluids to be transported into the pipeline, and are therefore a cause of contamination.

International Patent Application Publication No. WO 95/12741 discloses a method for displacing fluid from and cleaning a wellbore space of a vertical subterranean well. In the known method a sequence of different fluids is circulated into the well, first a displacement fluid, then a drive fluid, followed by a buffer fluid and a wash fluid. A viscous gel solution is used as drive fluid, to obtain "piston-like" characteristic for displacing displacement fluid without substantial mixing. Chloride brine or seawater buffer fluid is used between the drive and the wash fluid because it is expected that mixing with the drive fluid occurs, and can be provided in a density so as to mitigate large density differentials.

SUMMARY

It is an object of the present invention to provide a method of sequentially transporting fluids of different densities through a conduit, so that stratification can be prevented without the use of separation plugs (pigs or gel pigs).

In accordance with the present invention there is provided a method of sequentially transporting a first and a second fluid at a volumetric flow rate through a conduit having a cross-section, wherein the first and second fluids have different densities, which method comprises the steps of:

estimating a critical stratification condition for a fluid density profile along the conduit, which condition takes into account the densities of the first and second fluids, the cross-section of the conduit and the volumetric flow rate, and wherein violating the critical stratification condition likely results in stratification of fluids to occur; and feeding sequentially only first fluid, a buffer fluid and only second fluid into the conduit, wherein the buffer fluid has a density between the densities of the first and second fluids, such that a density profile of fluid along the conduit is provided, which does not violate the critical stratification condition.

DETAILED DESCRIPTION

Figure 1:
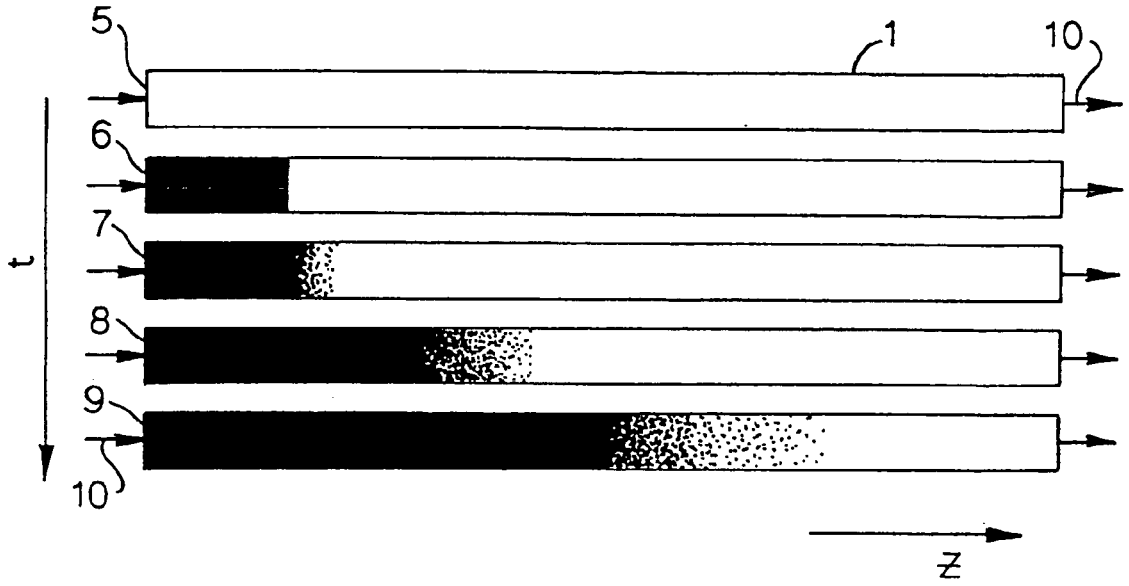
FIG. 1 shows schematically sequential flow of fluids of the same density through a conduit, at various times.

The invention is based on the insight gained by applicant that the sequential flow of fluids of different densities through a conduit does not always result in stratification, but only when a critical stratification condition is violated. The critical stratification condition relates to the fluid density as a function of the length coordinate of the conduit (the fluid density profile), and depends at least on the densities of the fluids, the volumetric flow rate, and the cross section of the conduit, i.e. the shape and size of the cross section. For example, at a given flow rate and cross-section, stratification of a second fluid fed into the conduit right after the first fluid will occur when the density difference between the fluids exceeds a certain critical value. A density step change along the conduit below that critical value, however, does not result in stratification. Estimating of the critical stratification condition can therefore suitably comprise estimating of a maximum allowable step change in fluid density along the conduit.

According to the invention the density is changed sufficiently gradual between the first and second fluids along the conduit, so that nowhere the critical stratification condition is violated.

In the practically important case that the conduit is a cylindrical pipe, estimating of the critical stratification condition suitably comprises estimating of a minimum allowable value of the so called modified Froude number, which is defined as $$Fr' = \frac{\bar{\rho}}{\Delta\rho}\frac{U^2}{gd}, \tag{1}$$

with the mean density $\bar{\rho}=(\rho_1+\rho_2)/2$ and the absolute density difference $\Delta\rho=|\rho_1-\rho_2|$, wherein $\rho_1$ and $\rho_2$ are the densities (units: kg/m$^3$) of the first and second fluids, U is the mean flow velocity (m/s), which is equal to the volumetric flow rate (m$^3$/s) of fluid through the pipe with a circular cross-section of diameter d (meters), divided by the cross-sectional area, and g is the gravity constant g=9.81 m/s$^2$. When reference is made to a density difference or to a density step in the specification and in the claims, the absolute value is meant in each case.

The modified Froude number is a parameter used alongside the Reynolds number to describe flow phenomena. Fr' can be interpreted as the ratio of inertia forces of the fluid ($\propto \bar{\rho}U^2$) and gravitational forces ($\propto\Delta\rho gd$). In the paper "Mischung in turbulenter Rohrströmung" by J. W. Hiby, Verfahrenstechnik vol. 4, Nr. 12, 1970, p. 538–543 the modified Froude number and Reynolds number are used in a study of the length required for full mixing of two miscible liquids, wherein the liquids are fed into a cylindrical pipe in a stratified fashion.

In the majority of practically relevant cases of flow through a conduit, in particular pipeline flow, the flow is turbulent, i.e. the Reynolds number is greater than about Re=3000. It has been found that once in the turbulent regime the exact value of the Reynolds number does not have a strong influence on the stratification tendency for normal miscible fluids. Applicant realized that a practically more relevant condition is obtained by considering the modified Froude number. It has been found that in many cases of pipe flow of miscible fluids the critical modified Froude number is between 14 and 16, in particular approximately 15, wherein stratification is likely to occur at modified Froude numbers lower than that critical modified Froude number.

In a situation where the conduit cross-section and maximum flow rate are predetermined, estimating of a minimum allowable modified Froude number is equivalent to, and can be done implicitly by, estimating a maximum allowable density step change.

When for a given situation the densities of the fluids, flow velocity and diameter of the pipe are known, the modified Froude number can be determined. One might think that there is little one could do if the number is lower than the critical value, since the densities of the first and second fluids, and the pipe diameter are predetermined, as is normally the flow velocity. Flow velocity is directly related to the volumetric flow rate at the given diameter, is in practice determined by the maximum pump capacity. In particular it is not normally possible to increase the flow velocity by increasing the pump rate.

Applicant has realized however, that the problem of a less-than-critical modified Froude number can be overcome by gradual bridging the density gap between first and second fluids. By introducing a buffer fluid of suitable density in between the first and second fluids one can achieve that locally, at each position along the conduit, the modified Froude number is above the critical value so that stratification does not occur.

Estimating the critical stratification condition can with advantage comprise estimating a critical density gradient which is a maximum allowable density difference between any two locations separated by a predetermined distance along the conduit. The maximum allowable density difference can suitably be chosen equal to a maximum allowable density step change. The latter can, for flow in a cylindrical conduit, be estimated from a critical (minimum allowable) modified Froude number.

Estimating the critical density gradient is particularly useful in the case that a relatively large density difference between the first and second fluids needs to be bridged, especially in the case that the density difference cannot be bridged by a buffer fluid with a single density $\rho_b$ intermediate between $\rho_1$ and $\rho_2$, since otherwise the step change between first fluid and buffer fluid and/or the step change from buffer fluid to second fluid would exceed the maximum allowable density difference. In such a case the density gap needs to be bridged by a buffer fluid which has tailored density profile.

In general the density profile can take various shapes with continuous and/or stepwise changing density. For example, the buffer fluid can form a density step profile of several sequential density steps, each less then the maximum allowable step change. It has been found that two or more density steps that are all less than the maximum allowable density difference for a single step, can still lead to stratification if they are not separated by a sufficiently long distance along the conduit. In order to take this effect into account, suitably the critical density gradient over a predetermined distance is taken into account.

The predetermined distance can be suitably chosen equal to or larger than a minimum required step spacing between steps in a density step profile with steps of the maximum allowable step change.

It is also possible to consider a buffer fluid forming a linear density profile between the first and second fluids. One can define a minimum required ramp length of a linear density profile between densities differing by the maximum allowable density difference is determined, and select the predetermined distance between any two locations equal to or larger than the minimum required ramp length.

Preferably, the buffer fluid is a mixture comprising first and second fluid, in particular a mixture substantially only containing the first and second fluids. This is a particularly advantageous embodiment of the present invention, as no other materials but the available process fluids are required. Suitably then, the buffer fluid is fed into the conduit by feeding co-currently first and second fluid into the conduit, upstream of a mixing device in the conduit. Mixing occurs in the mixing device, and is subsequently passed (fed) into the part of the conduit downstream of the mixing device. It is however also possible to premix the mixtures outside of the conduit.

The invention will now be described in more detail and with reference to the drawings.

Where like reference numerals are used in the Figures they are referring to the same or similar objects.

Reference is made to FIG. 1. FIG. 1 shows schematically a horizontal conduit 1 at several moments in time t, 5,6,7, 8,9. Through the conduit a first (indicated white) and a second fluid (indicated black) are passed sequentially, and flow in the direction of the arrows 10, along the length coordinate z. FIG. 1 shows the situation that both fluids have the same density, and the feed is changed from first to second fluid in a step change as indicated at 6. Since the interface between the two fluids is not rigid, some mixing at the interface is inevitable. On a molecular scale, diffusion will cause the two liquids to inter-penetrate. Furthermore, pipelines in industry are usually operated in the turbulent regime. The resulting velocity fluctuations will introduce axial dispersion of matter. Finally, the radial velocity distribution (caused by the fact that the liquid velocity at the wall is zero) will cause a difference in residence time between fluid elements residing close to the wall and elements close to the axis of the conduit. These effects will result in a certain degree of mixing at the interface, resulting in axial dispersion as indicated in gray (but homogeneous over a cross-section of the pipe). The resulting amount of mixed fluid after a certain length of the conduit is referred to as the interface length or interface volume, which can be experimentally studied or theoretically predicted.

Figure 2:
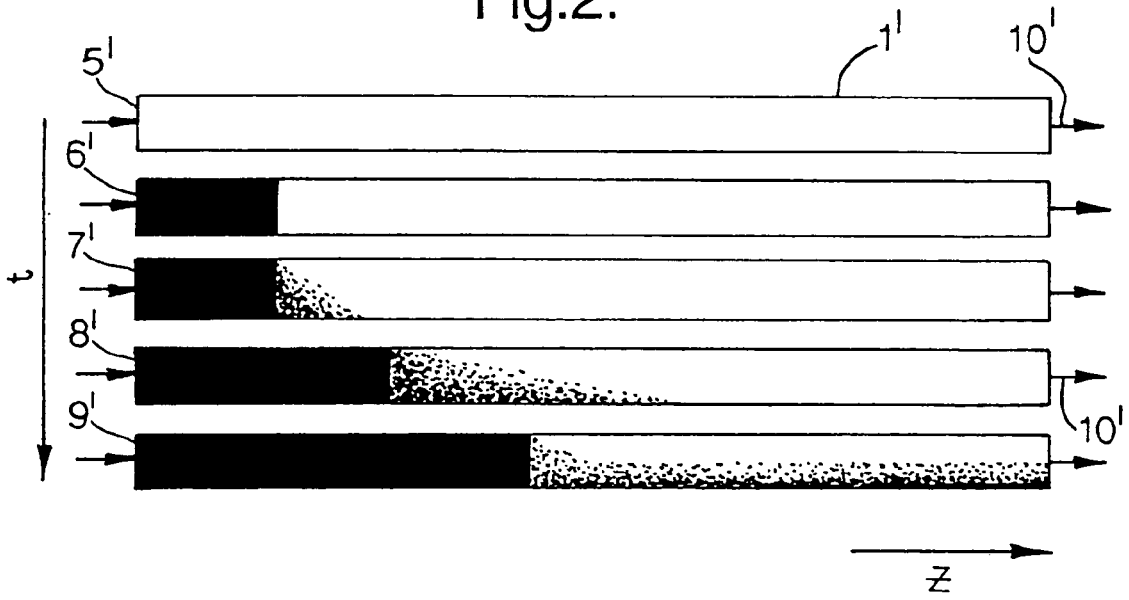
FIG. 2 shows schematically sequential flow of fluids of the different density through a conduit, at various times.

Reference is made to FIG. 2, showing a similar sequence of pictures, but now for the situation that the second fluid has a significantly higher density than the first fluid. The same reference numerals as for FIG. 1 are used, but primed.

The Figure illustrates the dramatic increase in interface loss in this situation. The densities differ sufficiently that the potential forces acting on the interface cause the fluids to form stratified layers in the pipeline. The stratified layers will migrate concurrently through the pipe, and the trailing product has to force out the first product by means of interface shear only. Such stratification can extend for hundreds or thousands of meters.

In case the conduit 1 is a pipe with circular cross-section, the modified Froude number Fr' as defined in equation (1) is a suitable parameter for assessing the stratification tendency. Fr' depends on the densities of the fluids (wherein the density difference has the largest effect), the diameter d of the pipe and the fluid velocity U (equivalent to the volumetric flow rate at a given diameter of the pipe).

In general, very little can be done to change the modified Froude number in practice: U is usually fixed by the pumping capacity, d is fixed by the pipeline installed, g is a physical constant, and $\bar{\rho}$ and $\Delta\rho$ are physical properties of the fluids. This means that, in cases corresponding to Fr'<15, stratification is often considered to be inevitable.

Applicant has realized, however, that stratification can be prevented if the change in density from the first to the second fluid is made gradual enough. Most importantly, no step changes in density along the conduit may occur that exceed a maximum allowable density change. If it is taken care that that a critical stratification condition is not violated, also for fluids of different density a behaviour essentially as depicted in FIG. 1 can be obtained.

Figure 3:
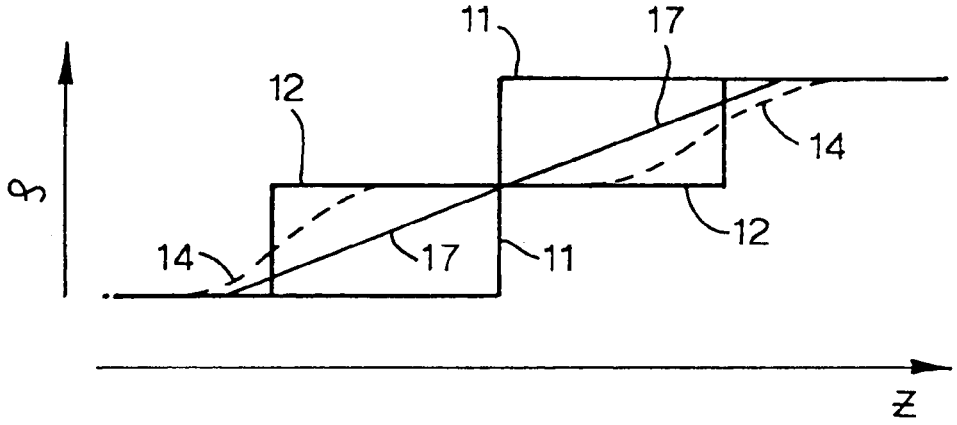
FIG. 3 shows schematically density profiles according to the invention.

Reference is made to FIG. 3, showing schematically a number of density profiles (density ρ as a function of the length coordinate z along the conduit). Assume that the conduit is a cylindrical pipe, and that the densities $\rho_1$ and $\rho_2$ of the fluids, the flow velocity and the diameter for a step change as indicated with reference numeral 11 correspond to an Fr'=7.5. A direct switch from feeding first fluid to feeding second fluid would lead to stratification.

If a buffer fluid having a density equal to the average of $\rho_1$ and $\rho_2$ is fed into the conduit after feeding pure first fluid and before feeding pure second fluid, a density profile as indicated as 12 is obtained. This can in particular be achieved by using a 50/50 by volume mixture of first and second fluids as the buffer fluid. If all other parameters are kept constant, for each of the step changes at the beginning and the end of the slug of buffer fluid one calculates a modified Froude number of Fr'=15. Let us further assume that Fr'=15 is the lower limit, beyond which (towards higher values) stratification is not likely to occur. Fr'≧15 represents a critical condition in this case so that stratification is prevented. Accordingly, by means of the slug of buffer fluid one can prevent stratification to occur.

The absolute density difference between the first fluid and the buffer fluid, and between the buffer fluid and the second fluid, in this case represents the maximum allowable step change since otherwise a Froude number smaller than Fr'=15 would be obtained.

The dashed line 14 indicates the shape of the density step profile 12, after flowing some distance along the conduit. Due to the normal mixing of fluids discussed with reference to FIG. 1, some axial dispersion occurs which smoothens step profile 12. It shall therefore be clear that a certain minimum distance should be observed between step changes, in particular between density changes of the maximum allowable step change. Otherwise the two step changes would quickly merge into one ramp profile that is so steep that stratification would occur. The minimum required spacing between step changes can for example be determined experimentally.

FIG. 3 further shows a linear density profile 17, which is also effective to prevent stratification in this case. Linear density profiles will be discussed in more detail below.

Figure 4:
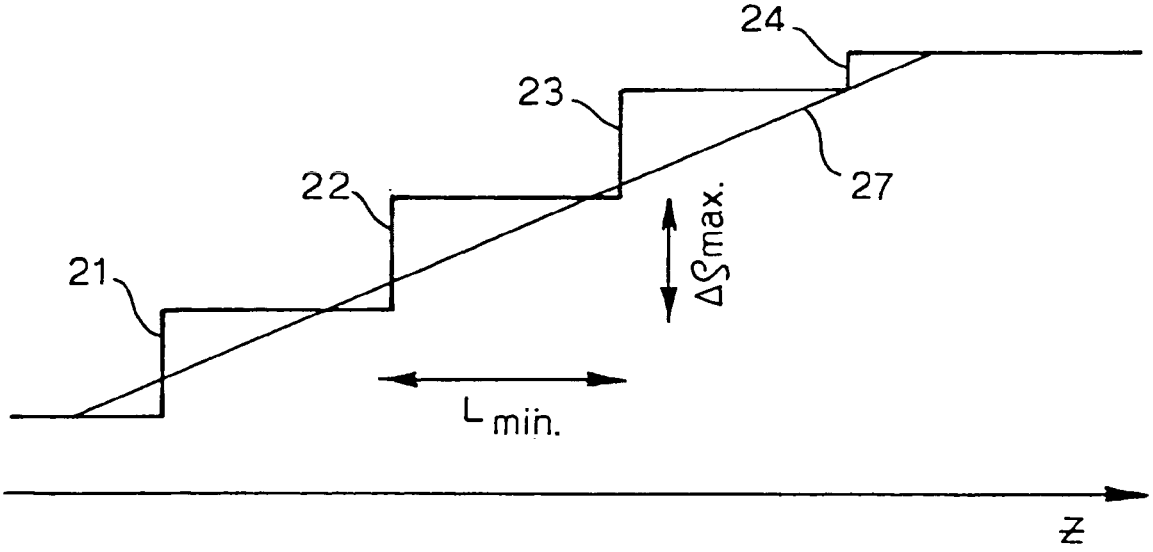
FIG. 4 shows schematically a step density profile according to the invention.

Reference is made to FIG. 4, showing a step density profile 20 with more steps than in FIG. 3. The profile has four steps, 21,22,23 and 24. The steps 21–23 are assumed to be equal to the maximum allowable density step change $\Delta\rho_{max}$ corresponding to Fr'=15, so that stratification is unlikely to occur under the prevailing conditions. The step 24 is a smaller step. The distance $L_{min}$ between all consecutive steps is equal to the minimum required spacing between two step changes of maximum allowable magnitude $\Delta\rho_{max}$, and has for example be determined experimentally.

There is also shown a linear density profile 27 which is suitable to prevent stratification. It shall be clear that many other shapes of density profiles are effective to prevent stratification as well. However, the profile may not be too steep over short distances. In principle the limiting conditions can be straightforwardly determined in experiments for various profiles.

A useful criterion can be obtained if a critical density gradient is determined as a maximum allowable density difference, equal to the maximum allowable step change Δρmax, between any two locations that are separated by a predetermined distance along the conduit, in this case suitably the distance $L_{min}$. Applicant has found that another density profile also can prevent stratification if the density difference, between any two points along the profile, spaced by $L_{min}$, is equal to or less than $\Delta\rho_{max}$. This is for example the case for the linear profile 27.

An alternative way to select the predetermined length for determining the density gradient can be based on measurements of the minimum required length of a buffer fluid with a linear density profile. On the profile, points can be selected between which the density difference equals a maximum allowable step change, in particular a density difference corresponding to Fr'=15. The distance between these points can also be suitably selected as the predetermined length.

EXAMPLE 1

Assume the densities of the fluids to be $\rho_1$=950 kg/m$^3$ and $\rho_2$=1050 kg/m$^3$, and a flow velocity of 1 m/s in a cylindrical pipe of 0.1 m diameter. The modified Froude number calculated with equation (1) in this case is 10.2, i.e. lower than the critical limit of 15. Still, stratification can be prevented by feeding a sufficiently long slug of a 50/50 (by volume) mixture of the first and second fluids as buffer fluid ($\rho_b$=1000 kg/m$^3$) after feeding only first fluid and before feeding only second fluid into the pipe. The modified Froude number at the front and tail of the buffer fluid is 20.4, i.e. above the critical value.

EXAMPLE 2

We will now discuss experiments that have been conducted in conjunction with the present invention.

Figure 5:
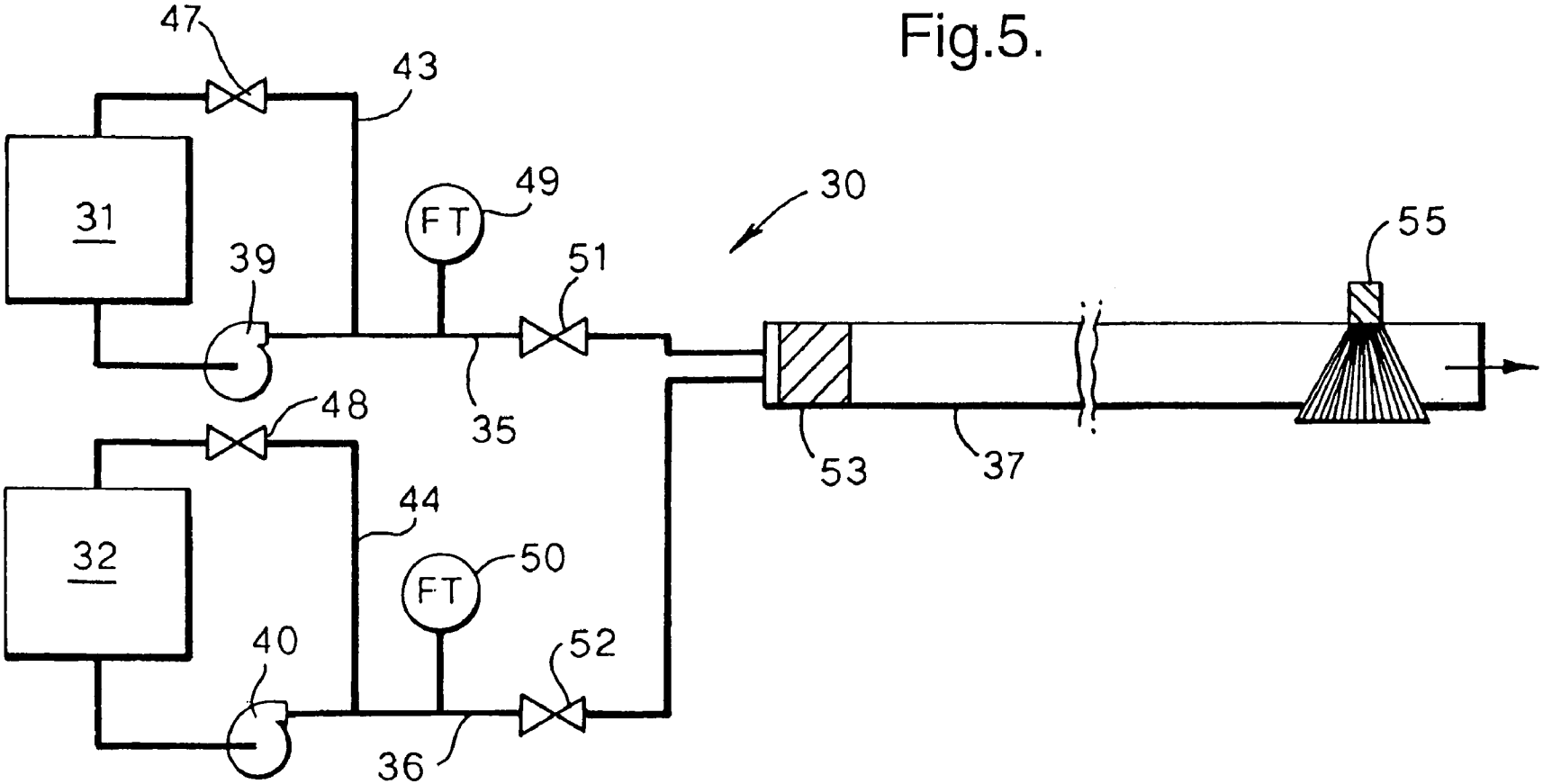
FIG. 5 shows schematically the test rig used for experiments.

Reference is made to FIG. 5, showing schematically a test rig 30 that was used for the experiments. The test rig 30 has two tanks for light and heavy liquid, a fresh water tank 31 and a salt water tank 32, with densities of 1000 and 1010 kg/m$^3$, respectively. It is appreciated that density differences of various refinery fluids are sometimes much larger, but by means of the modified Froude number general indications for the behaviour of normal miscible fluids can be obtained. The outlet of each tank is connected via a horizontal feeding conduit 35,36 to the inlet end of a cylindrical pipe 37 of 15 m length and d=0.05 m diameter. Each feeding line is provided with a pump 39,40, a feedback loop 43,44 with valve 47,48, a flow meter 49,50, and a computer controllable valve 51,52. At the inlet end of the pipe 37 a conventional static mixing device 53 was arranged, so that a fully mixed fluid is obtained at the downstream end of the mixing device 53. Suitably the fluid is mixed such that, after the mixer 53, the coefficient of variation of concentration over the cross-section of the conduit, which is equal to the standard deviation divided by the mean concentration, is smaller than 10%, preferably smaller than 5%.

Using the computer controlled valves, a fluid of a predetermined mixing ratio as a function of time can be fed into the pipe 37. Feeding according to a time program corresponds to providing a density profile along the conduit. It shall be clear that there are practical limits to the actual precision of the profile obtained, in particular to the sharpness of edges in a step profile.

Near the end of the pipe 37, a monitoring device 55 is arranged which serves to determine if the flow at this position is stratified or not. The monitoring device used applies a laser visualization technique, and for this reason a fluorescent dye was added to the salt water.

After feeding only fresh water into the pipe 37 at a selected flow rate, a mixture of fresh and salt water was fed into the pipe, such that a linear ramp between the density of the fresh water and the density of the salt water in the two tanks 31,32 is obtained. To this end the pumps 39,40 and computer controllable valves 47,48 are operated for a certain mixing time interval such that linear decreasing and increasing volumes of fresh and salt water are fed into the mixer, wherein the total fluid flow (influx) rate was kept constant at the same value as the flow rate when feeding only fresh water. The duration of the mixing time interval was varied, and in this way linear density profiles of varying length $l_{mix}$ were provided. After the end of the time interval only salt water was fed at the same flow rate.

Different values of the flow rate were selected for various experiments, so as to span a range of modified Froude numbers between 5 and 18, calculated according to equation (1) using the densities of the fresh and salt water directly. In each experiment it was observed with the monitoring device if a stratified flow is obtained or not.

Figure 6:
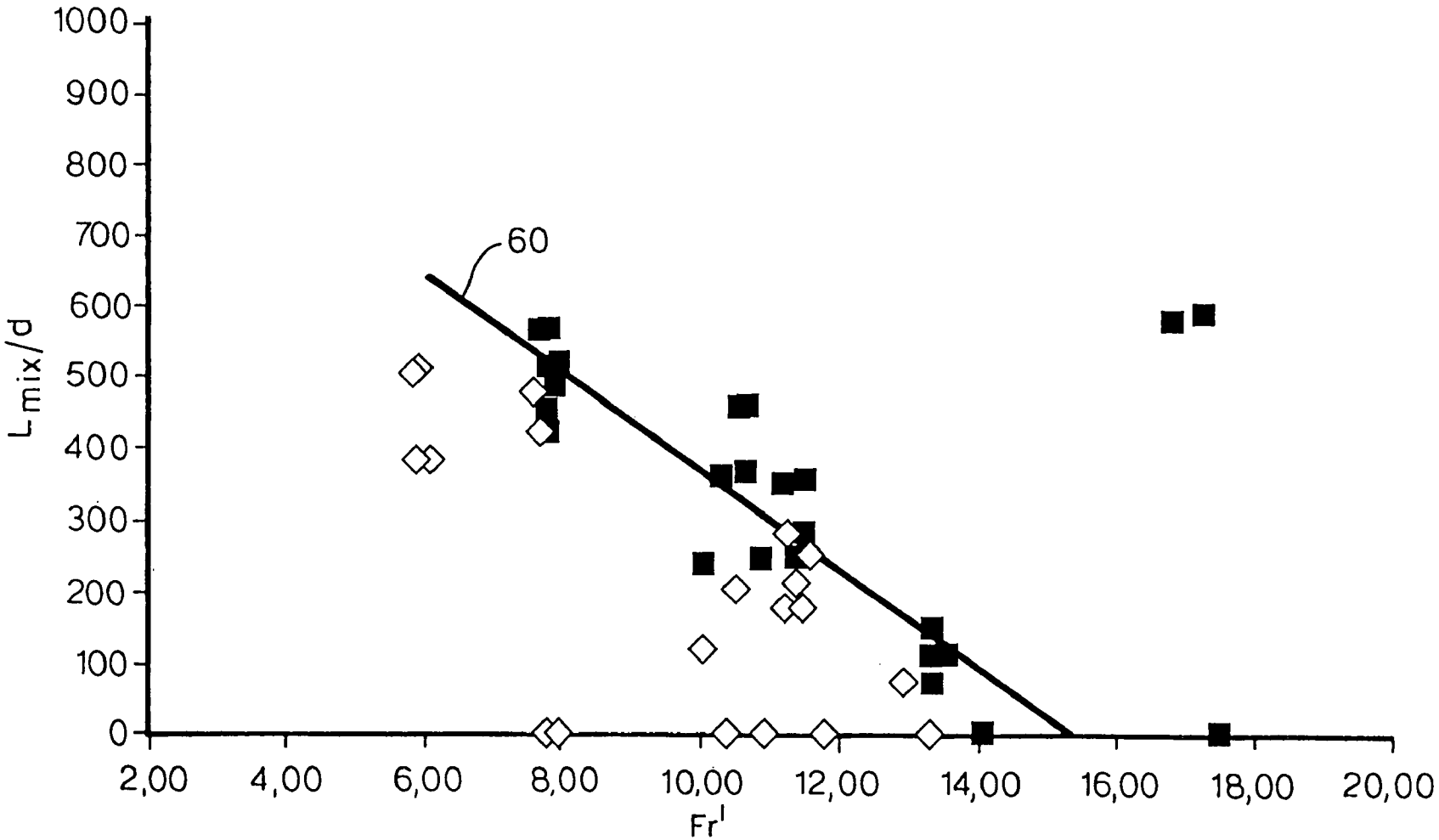
FIG. 6 shows results obtained in stratification experiments in the test rig of FIG. 5.

FIG. 6 displays the results obtained in these experiments. The length of the density ramp $L_{mix}$ is divided by the diameter of the pipe to obtain a dimensionless number on the ordinate. On the abscissa the dimensionless modified Froude number is set out. The datapoints for a certain combination of Fr' and $L_{mix}$/d indicate if stratification was observed (indicated as diamonds) or not (indicated as squares).

For modified Froude numbers larger than Fr'=15 no stratification was observed. For modified Froude numbers below 15, stratification was observed, but could generally be prevented by using a linear density profile of sufficient length according to the invention between the pure fluids from both tanks. Further it was found that the lower the modified Froude number calculated for the pure fluids from both tanks was, the longer the length of the linear density profile that is required.

The line 60, for which a linear approximation appears appropriate, separates different regions in FIG. 6. Below the line 60, stratification is likely to be observed. For a given modified Froude number stratification can be prevented if a linear density profile is provided having a length that is at least equal to the ordinate value pertaining to that Fr' as indicated by the line 60. It can be desirable in practice to select the length of the linear profile somewhat longer than the critical value, for example to account for the possibility that the mixing of fluids in the buffer fluid is not yet perfect. For all modified Froude numbers larger than 15 no special measures need to be taken to prevent stratification.

The line 60 represents a special form of a critical stratification condition for the case that a linear density profile is applied. In a practical situation the modified Froude number between first and second fluids can be determined, and it can be determined at the hand of FIG. 6 if a density profile is required and what the length of the linear density profile should be.

It shall be clear that similar graphs like FIG. 6 can be determined for other situations, e.g. for conduits of non-circular cross-section, fluids that are in their mixing behaviour substantially different from fresh/salt water, or different shapes of a density profile such as a single or multi-step profile.

When a mixture of only first and second fluids is used as buffer fluid, unnecessary contamination of the conduit is prevented. Mixtures can be prepared at the upstream end of the conduit, but can also be pre-mixed outside of the conduit. For example, premixed batches can be held in stock, or a mixing vessel can be arranged upstream of the conduit.

If the parameters influencing the stratification condition change along the conduit, such as a changing diameter, or a change in flow velocity due to pumping capacity, it shall be clear that the most difficult situation (e.g. largest cross section, lowest flow velocity) along the conduit shall be considered for estimating the critical stratification condition.

In the examples, a circular pipe such as a conventional pipeline has been used. It shall be clear, however, that the principles of the present invention also apply to conduits having a cross-section of other shape, e.g. rectangular. The stratification tendency will be governed by a parameter similar to the modified Froude number of equation (1), which might be determined analytically, or which can be studied experimentally so that a quantitative critical stratification condition can be derived.

In the discussion it has been assumed that the fluids are miscible, and that the energy of mixing can be neglected. In some cases the latter assumption may not be justified, for example when mixing water and methanol where substantial heat is produced. Such mixing effects need also be taken into account in the critical stratification condition, so that even in the case of transport through a cylindrical pipe, a further modification and/or a different critical value of Fr' would need to be used.

The effect of stratification is based on the different directions of the gravity force and flow direction, and can in general occur not only in horizontal conduits but also in inclined conduits. It shall be clear that the method of the present invention can with advantage be applied for transporting fluid through a conduit that is at least partially or fully non-vertical, in particular at least partially or fully horizontal or nearly horizontal (within 20 degrees from the horizontal). At least partially means that the respective length of conduit is long enough for stratification to develop. Stratification becomes less of a problem the larger the deviation from the horizontal is. The critical stratification condition will therefore normally consider the most horizontal part of the conduit. If it is warranted that stratification cannot occur there, it is not expected to occur in more inclined parts. For the above considerations of the modified Froude number a horizontal conduit has been considered. It will be understood that for deviations from the horizontal a different critical stratification condition may be needed, which can for example take the specific effects of multi-component flow in an inclined conduit into account.

That which is claimed is:

1. A method of sequentially transporting a first and a second fluid at a volumetric flow rate through a conduit having a cross-section, wherein the first and second fluids have different densities, which method comprises the steps of:

estimating a critical stratification condition for a fluid density profile along the conduit, which condition takes into account the densities of the first and second fluids, the cross-section of the conduit and the volumetric flow rate, and wherein violating the critical stratification condition likely results in stratification of fluids to occur; and feeding sequentially only first fluid, a buffer fluid and only second fluid into the conduit, wherein the buffer fluid has a density between the densities of the first and second fluids, such that a density profile of fluid along the conduit is provided, which does not violate the critical stratification condition.

2. The method according to claim 1, wherein estimating the critical stratification condition comprises estimating a maximum allowable step change in fluid density along the conduit.

3. The method according to claim 2, wherein the conduit is cylindrical having a diameter, and wherein estimating the critical stratification condition comprises estimating a minimum allowable value of the modified Froude number.

4. The method according to claim 3, wherein the estimated minimum allowable value of the modified Froude number is between 14 and 16.

5. The method according to claim 4, wherein estimating the critical stratification condition comprises estimating a critical density gradient which is a maximum allowable density difference between any two locations separated by a predetermined distance along the conduit.

6. The method according to claim 5, wherein a maximum allowable step change in fluid density along the conduit is estimated, wherein further a minimum required step spacing between steps in a density step profile with steps of the maximum allowable step change is determined, wherein the maximum allowable density difference is selected equal to the maximum allowable step change, and wherein the predetermined distance between any two locations is equal to or larger than the minimum required step spacing.

7. The method according to claim 5, wherein a maximum allowable step change in fluid density along the conduit is estimated, wherein further a minimum required ramp length of a linear density profile between densities differing by the maximum allowable step change is determined, wherein the maximum allowable density difference is selected equal to the maximum allowable step change, and wherein the predetermined distance between any two locations is equal to or larger than the minimum required ramp length.

8. The method according to claim 7, wherein the buffer fluid is a mixture comprising first and second fluid.

9. The method according to claim 8, wherein the buffer fluid is fed into the conduit by feeding co-currently first and second fluid into the conduit, upstream of a mixing device arranged in the conduit.

10. The method according to claim 8 wherein the mixture is premixed before feeding into the conduit.

* * * * *